United States Patent [19]

Michel et al.

[11] Patent Number: 4,477,194

[45] Date of Patent: Oct. 16, 1984

[54] DEVICE FOR CONTROLLING THE FUNCTIONS OF AN ELECTRONIC WATCH

[75] Inventors: Jean-Georges Michel, Neuchatel; Hubert Portmann, Rothenburg; Ali Schneiter, Neuchatel, all of Switzerland

[73] Assignee: Ebauches, S.A., Switzerland

[21] Appl. No.: 196,775

[22] Filed: Oct. 14, 1980

[30] Foreign Application Priority Data

Dec. 6, 1979 [CH] Switzerland ..... 10814/79

[51] Int. Cl.³ ..... G04C 17/00; G04B 19/00

[52] U.S. Cl. ..... 368/69; 368/224; 368/276

[58] Field of Search ..... 368/69, 70, 85–87, 368/155, 156, 185–188, 319–321; 310/318, 319; 340/365 A, 365 S; 84/1.14, 1.16, 1.24, DIG. 7; 328/59, 65

[56] References Cited

U.S. PATENT DOCUMENTS

| | | | |
|---|---|---|---|
| 4,185,621 | 1/1980 | Morrow | 310/319 X |
| 4,190,785 | 2/1980 | Kompaner | 340/365 A |
| 4,246,650 | 1/1981 | Moritani et al. | 368/188 |
| 4,257,114 | 3/1981 | Sekiya et al. | 368/188 |
| 4,282,513 | 8/1981 | Meisner et al. | 368/185 |
| 4,305,321 | 12/1981 | Cohn | 84/1.24 |
| 4,308,607 | 12/1981 | Sekita et al. | 368/187 |

*Primary Examiner*—Vit W. Miska

*Attorney, Agent, or Firm*—Allegretti, Newitt, Witcoff & McAndrews, Ltd.

[57] ABSTRACT

The case 1 of the watch comprises elements consisting of ribbed zones 3, 4 and 5 of different structures which can supply mechanical vibrations when they are rubbed by the user of the watch.

A transducer transforms these acoustic vibrations into an electric signal. An electronic circuit comprising generator means, a pulse shaper, counters, a register and a comparator allows the vibration message generated by the activation of one or the other of the ribbed zones 3, 4 and 5 to be decoded and one or the other of the functions appearing on the display 2 of the watch to be controlled.

12 Claims, 10 Drawing Figures

DEVICE FOR CONTROLLING THE FUNCTIONS OF AN ELECTRONIC WATCH

BACKGROUND OF THE INVENTION

The object of the present invention is an improved device for controlling the functions of an electronic watch.

Current electronic watches, particularly those provided with a numeric display, often are equipped with numerous functions as, for example, synchronization, multiple alarm, time zones and the like.

These different functions may be controlled by means of one or several push-buttons arranged on the periphery of the watch and incorporated in the thickness of the watch, and which act mechanically on an electric contact placed on the electronic module located in the case.

These push-buttons pose technological problems which are difficult to solve because of the requirements which respect to leaktightness, reliability and price, especially if they must fit into very thin watches.

Devices also are known which carry out the role of electronic switches based on the principle of the detection either of a change in capacity or of a change in resistance when the user places his finger on a predetermined spot on the glass or the case of the watch.

The disadvantage of a device with capacitive action is that it consumes a great deal of energy. In fact, the capacitive divider containing the capacity which can be varied according to the position of the finger must constantly have an alternating current flowing through it.

A system with resistive action presents the disadvantage, in addition to great energy consumption, of being particularly sensitive to dirt adhering to the surface of the case. It is thus difficult to ensure that this device will function correctly.

Besides, these two later types of device pose very great aesthetic and technological problems in the construction of the case. As a matter of fact, the contact surfaces adapted to the finger and the electrical connections to the electronic module must be combined, to allow for the requirements of leaktightness and reliability and utilization of the available surface.

BRIEF SUMMARY OF THE INVENTION

It is the object of the present invention to eliminate the above-described disadvantages of known devices. This object is achieved in accordance with the invention by the provision of watch case elements consisting of ribbed zones of different structures which can supply mechanical vibrations when they are rubbed. A transducer transforms these acoustic vibrations into an electrical signal. An electronic circuit decodes the electrical signals generated by the activation of the ribbed zones to control the functions appearing on the display of the watch.

BRIEF DESCRIPTION OF THE DRAWINGS

The invention will be described in more detail, by way of example, by reference to the accompanying drawings which illustrate, illustrative embodiments of the invention, as follows.

DETAILED DESCRIPTION OF THE PREFERRED EMBODIMENTS

Figure 1:
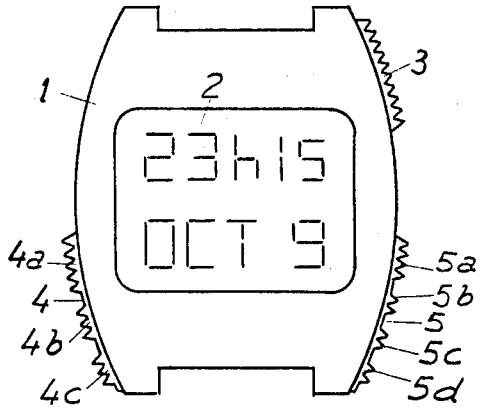
FIG. 1 is a plan view of a first illustrative embodiment of a watch case.

FIG. 1 illustrates an electronic watch comprising a case 1 and a digital display device 2. The case 1 has at its periphery three zones 3, 4 and 5 on which there are ribbed grooves similar to those on files.

These ribbed zones, or file riffles, carry grooves of substantially triangular section for example the file grooves 4 and 5 are respectively arranged in groups 4*a* to 4*c* and 5*a* to 5*d*, separated by regular or smooth spaces. The first group 4*a*, 5*a* of these two ribbed zones comprises, for example, four teeth. Further, in this example, the two other groups 4*b* and 4*c* of file riffle 4 comprise three teeth each and the three other groups 5*b*, 5*c* and 5*d* of file riffle 5 are formed only with two teeth each.

The user may scrape the files 3, 4 or 5 with his finger nail or with an appropriate object, for example a ballpoint pen, which produces mechanical vibrations in the watch case 1. These latter are acoustically transmitted, without any movable mechanical element or electric connection, to an electronic circuit situated inside the watch, as described below.

Figure 2:
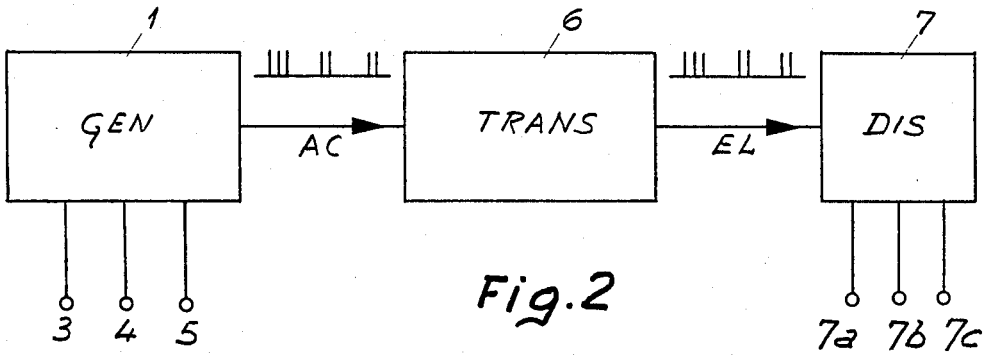
FIG. 2 is a block diagram of an illustrative embodiment of the electronic module.

The block diagram of FIG. 2 explains the operation of the device according to the invention.

The case 1 of the watch transmits the mechanical vibrations produced by rubbing an object on the ribbed zones 3, 4 or 5 directly to an electromechanical transducer 6. This latter supplies to a discriminator 7 an electric signal which comprises one pulse for each tooth of the zone rubbed and which is, therefore, the electric image of this zone, the pulses forming groups separated by spaces, each group and each space corresponding to a group of teeth and to a space between groups of teeth of the zone rubbed. The discriminator 7 detects the source of the electric signal by counting the number of pulses of each group and delivers a control signal for watch functions at one or the other of its outputs 7*a*, 7*b* or 7*c*, depending on whether file riffle 3, 4 or 5 has been rubbed.

Figure 3:
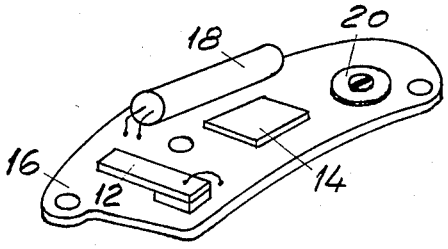
FIG. 3 represents an embodiment of the electronic module.

FIG. 3 represents an example of the electric module mounted in the case 1 of the watch. This module comprises a thin ceramic piezo-electric plate 12 which is metallized on both of its surfaces, and a circuit 14 in which all the electronic circuits of the watch are integrated, which are supported by a printed circuit 16 carrying also a quartz oscillator 18 and an adjustable capacitor 20. The plate 12 which, in this example, constitutes the transducer 6 of FIG. 2, supplies an electric signal to the circuit 14 when it is deformed by the mechanical vibrations which are transmitted to it by the case 1 and the printed circuit 16 (which is fixed in the case 1). Such a transducer presents the advantage that it does not consume any current when at rest.

In another illuatrative embodiment, the transducer 6 advantageously consists of a piezo-resistive element integrated in the circuit 14 with the other electronic circuits. The vibrations of the watch are then detected by the variations of the electric resistance of this element.

Figure 4:
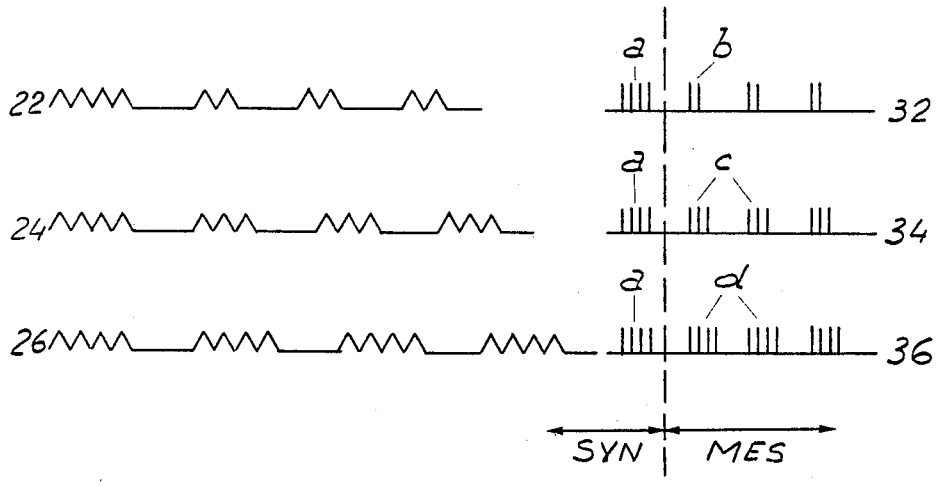
FIG. 4 is a diagram illustrating the electric signals produced as a function of the profile of the ribbed zones.

FIG. 4 shows, with respect to the profile of the three file riffles 22, 24 and 26, the corresponding idealized electric signals 32, 34 and 36 supplied by the transducer 6. Each peak of the triangles forming the file profile corresponds to one short electric pulse.

Each signal 32, 34 or 36 may, for example, comprise a first train of four pulses a corresponding to four first teeth of the files 22, 24 and 26 which serves as locating or synchronizing signal. This first pulse train is followed by three trains b, c and d of, respectively, two, three and fourth teeth of the files 22, 24 and 26. These latter pulse trains contain the information intended for controlling the desired watch function. The pulses are arranged in this manner in order to render the signal insensitive to parasitic oscillations.

The detection of the pulse trains and of the information contained therein is based on the following observation: if the ribbed zone is rubbed at a reasonable speed, which is always the case in practice, the variation in speed between the beginning and the end of the rubbing of the zone never exceeds a factor of two. Any period separating two successive pulses which is much greater than twice the period of time separating the first of such two pulses from the preceding one can, therefore, be considered as a pulse separating two pulse trains. The principle of the discriminating circuit 7 is, therefore, to measure the time separating two pulses and to compare this time to that separating the first of these pulses from the preceding one. As a result of this comparison it can be determined whether these two pusles are part of the same pulse train or not, and in this way the number of pulses of each train can be counted. This number, finally, determines which output *7a*, *7b* or *7c* of the discriminator 7 supplies a control signal.

Figure 9:
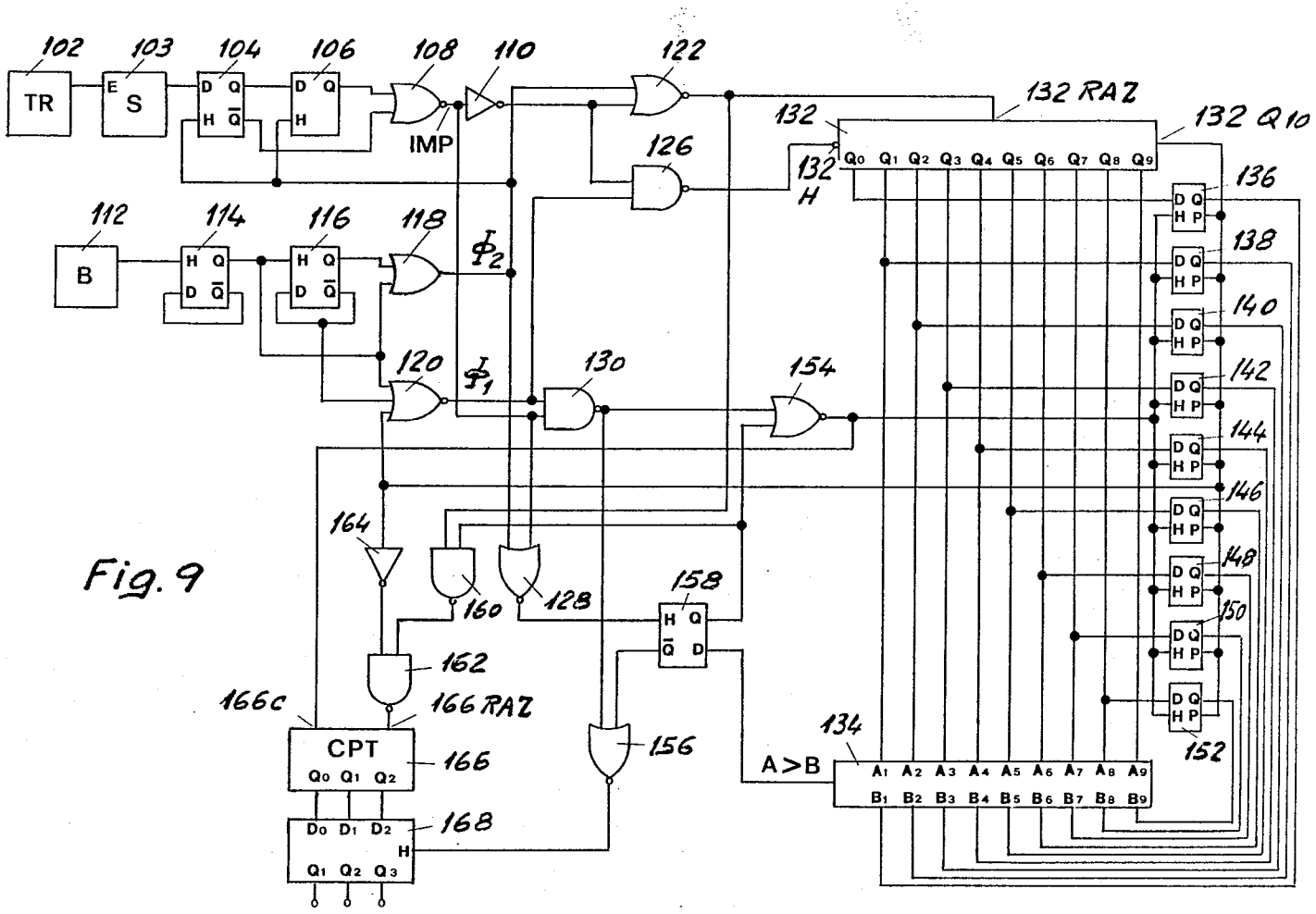
FIG. 9 represents the diagram of an electronic circuit which supplies the information contained in the profile of a ribbed zone.

The diagram of an electronic circuit suitable for implementing these functions is shown, by way of example, in FIG. 9.

In order to simplify the description, the following abbreviations will be used:

Logic state 0 or 1: "0" or "1"
Flip flop D: FF
Binary counter: CPT
Reset: RAZ
Input (or output) i of element X: Input (or output) Xi A transducer 102, such as has been described for FIGS. 2 and 3, is connected to the input 103E of a Schmitt trigger 103. The output of the latter is connected to a FF 104 at its data input 104D. Its output 104Q is connected to a FF 106 at its data input 106D. The output of 106Q of this flip flop is connected to the first input of a NOR gate 108, the second input of this latter being connected to the inverted output 104$\overline{Q}$ and its output going particularly to the input of an inverter 110.

A quartz oscillator 112 used as time base is connected to the clock input 114H of a FF 114. The inverted output 114$\overline{Q}$ goes to the data input 114D and the noninverted output 114Q is connected to another FF 116 at its clock input 116H. The inverted output 116$\overline{Q}$ is also connected to the data input 116D of the same flip flop and the noninverted output 116Q is connected to the first input of an OR gate 118. The second input of this latter is connected, on the one hand, to the output 114Q, and, on the other hand, to a first input of a three-input NOR gate 120. The second input of the gate 120 goes to the inverted output 116$\overline{Q}$.

The output of the inverter 110 is connected to a first input of a NOR gate 122 and to a first input of a NAND gate 126. The second input of the gate 122 is connected, on the one hand, to the output of the OR gate 118 and, on the other hand, to the clock inputs 104H and 106H and to a first input of a NOR gate 128.

The second input of the gate 126 and a first input of a NAND gate 130 are connected to one another and also to the output of the gate 120. The second inputs of the gates 128 and 130 are connected to one another and to the output of the gate 108.

The input 132H of a ten-stage binary counter (CPT) 132 is connected to the output of the gate 126 and its reset input 132 RAZ is connected to the output of the gate 122. The outputs 132Q1 to 132Q8 of CPT 132 are connected, respectively, on the one hand, to the inputs A1 to A8 of the ninestage binary comparator 134 which may be designed, for example, like the integrated circuit currently sold by National Semiconductor Inc. and designated MM 74 C 85 and, on the other hand, to the data inputs 138D to 152D of eight FF 138 to 152. The outputs 132Q0 and 132Q9, respectively, go to the input 136D of a FF 136 and to the input A9 of the comparator 134. *This output 132Q10 is connected, on the one hand, to the preselection inputs 136P to 152P of the FF 136 to 152 and, on the other hand, to the third input of the gate 120. The nine inputs B1 to B9 of the comparator 134 are connected, respectively, to the nine outputs 136Q to 152Q of the FF 136 to 152. The clock inputs 136H to 152H of the FF 136 to 152 are connected to one another and to the output of a two-input NOR gate 154.

*The output 132 $Q_{10}$ is arranged to provide the logical signal "1" when the ten stages of the counter 132 are in the state "1".

The output of the gate 130 is connected, on the one hand, to the first input of the gate 154 and, on the other hand, to a first input of a NOR gate 156.

The output of the gate 128 is connected to the clock input 158H of a FF 158. The direct output 158Q of this latter is connected, on the one hand, to the second input of the gate 154 and, on the other hand, to a first input of a NAND gate 160, the second input of this latter being connected to the output of the gate 122.

The output 132Q10 is also connected to a first input of a NAND gate 162 via an inverter 164, the second input of this latter gate being connected to the output of the gate 160.

The output A>B of the comparator 134 is connected to the data input 158D of the FF 158. The inverted output 158$\overline{Q}$ of this latter goes to the second input of the gate 156.

The output of the gate 154 is also connected to the counting input 166C of a four-stage counter 166. The reset input 166 RAZ of this counter is connected to the output of the gate 162. The outputs 166Q of the stages of the CPT 166 go to the inputs 168D of a decoder 168. The control input 168H of the latter is connected to the output of the gate 156.

It is known that, in binary arithmetic, any number can be divided by two simply by shifting all the bits of this number in the direction of the least significant bit. This last bit then represents the remainder of the division.

Thus, a number $N_2$, equal to half the number $N_2$ is applied to the inputs $A_1$ to $A_g$ of the comparator 134. As a matter of fact, the least significant bit of $N_2$, which is represented by the logic state of the output 132Q0 of the counter 132, is not applied to the comparator 134. It is the next bit of $N_2$, represented by the logic state of the output 132Q1 of the counter 132, which is applied to the first input $A_1$ of the counter 134, the following bits of $N_2$ being applied, in increasing order of significance, to the inputs $A_2$ to $A_9$ of the comparator 134.

As practical tests have shown, the times $T_1$ and $T_2$ never differ by more than 10 to 15% when consecutive teeth are rubbed.

The output A>B of the comparator 134 is thus always at "0" at the instant when the third IMP pulse appears since a half of time $T_2$, represented by the binary number $N_2$, applied to the inputs $A_1$ to $A_9$ of the comparator 134, is certainly less than the time $T_1$, represented by the binary number $N_1$ applied to the inputs $B_1$ to $B_9$ of the comparator 134.

The FF 158 thus remains at zero and the next pulse $\phi_1$ is transmitted by the gates 130 and 154 to the clock input of the register 136–152. This pulse causes the number $N_2$ to be transferred into the register 136–152 where it replaces the number $N_1$. Simultaneously, the counter 166 is incremented and its contents change from one to two. The output of the gate 156 still stays at "0".

The change of $\phi_2$ to "0" just before the end of the IMP pulse causes the counter 132 to be reset, as described above.

Figure 10:
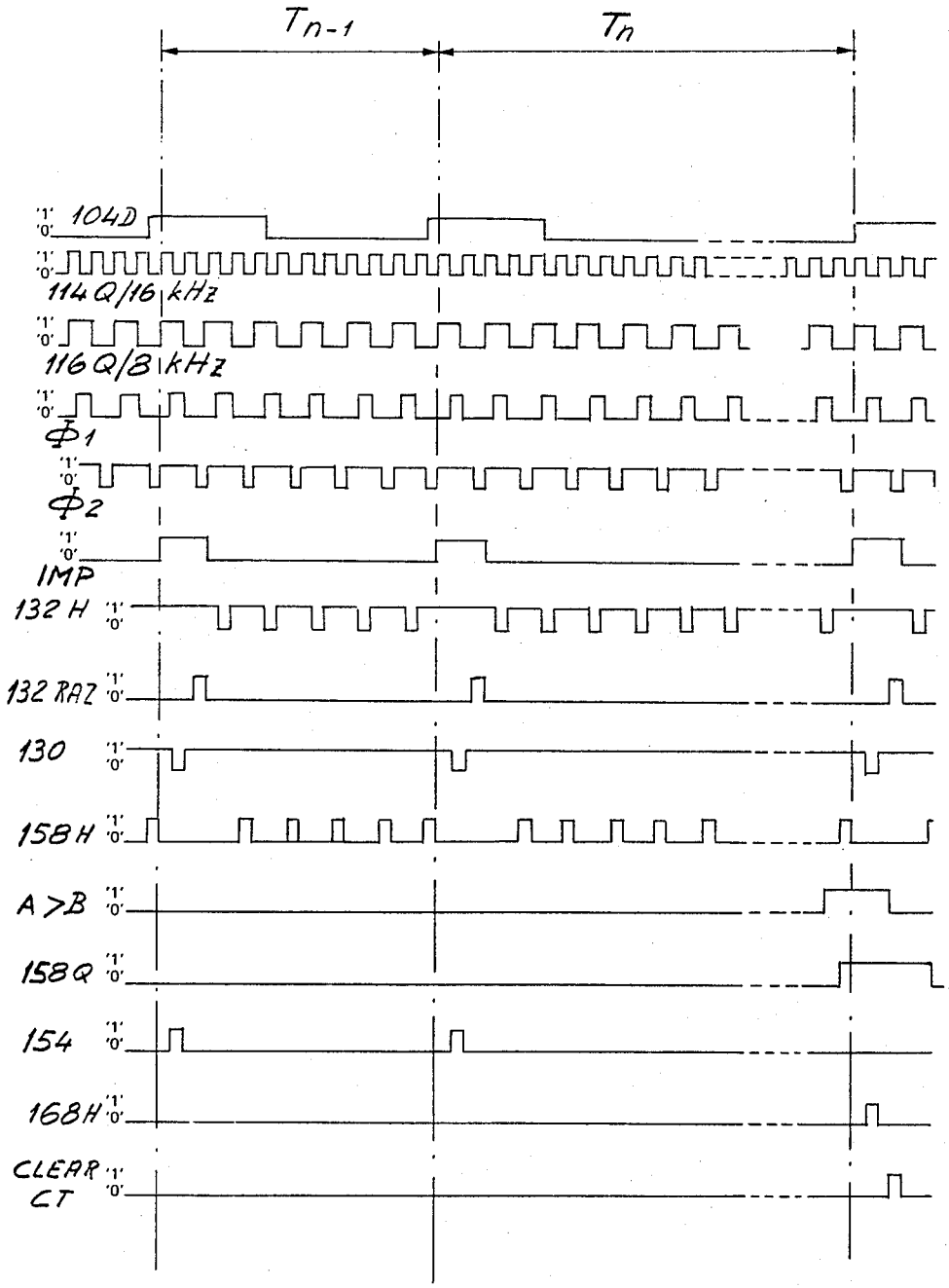
FIG. 10 illustrates the logic states at different points in the circuit of FIG. 9.

The detailed operation of the circuit of FIG. 9 will now be described with the aid of the diagram of FIG. 10 which indicates the logic states at different points in this circuit.

The crystal oscillator 112 used as time base provides pulses at a frequency of about 32 kHz to the clock input of the flip flop 114. The flip flops 114 and 116 divide this frequency by two and by four and the outputs 114Q and 116Q supply pulses having frequencies of 16 kHz and 8 kHz, respectively.

The gate 120 supplies at its output a signal $\phi_1$ when its three inputs are at "0". This $\phi_1$ signal is thus formed by pulses with a frequency of 8 kHz and a duration which is equal to half a period of the 16 kHz signal supplied by the output 114Q.

The output of the gate 118 supplies a signal $\phi_2$ the shape of which is identical to the signal $\phi_1$, but displaced by half a period and inverted with respect to the latter.

The oscillator 112, the two FF 114 and 116 and the two gates 118 and 120 thus constitute a two-phase generator supplying the signals $\phi_1$ and $\phi_2$.

When one of the file riffles is rubbed by the user, the transducer 102 supplies pulse trains, the shape of which depends on the profile of the teeth of the file and on the type of transducer. In the present example, each pulse train 103E contains two pulses.

The Schmitt trigger 103 shapes the pulses supplied by the transducer 102 and delivers a logic signal, designated by 104D, to the data inputs of FF 104. This latter, controlled by the signal $\phi_2$ applied to its clock input, thus supplies at its output 104Q pulses with the same period as that of the pulses from the transducer 102 and of a duration equal to an exact multiple of the period of the signal $\phi_2$.

The flip flop 106 switches one period of the signal $\phi_2$ later than the flip flop 104 and, in consequence, it delivers at its output 106Q a signal of the same shape as the signal present at the output 104Q but displaced by a period which is equal to one period of the signal $\phi_2$.

The two signals supplied by the outputs 104Q and 106Q are applied to the inputs of the NOR gate 108 and the latter produces at its output a pulse IMP, with a duration of about 122/.s (one period of the signal $\phi_2$), for each pulse supplied by the transducer 102.

As long as none of the "files" are rubbed, the signal IMP stays at the logic state "0". The input 132 RAZ is thus also at "0" and the counter 132 can count the pulses which it receives at its input 132H.

Supposing initially that the output 132Q 10 of this counter is at "0", the gate 120 supplies at its output the pulses $\phi_1$ as described above. These pulses are transmitted to the input 132H by the gate 126, the first input of which is at "1".

When the output 132Q10 changes to "1", that is to say when the counter 132 reaches its hightest count, the output of the gate 120 changes to "0" and remains there. The counter 132 thus receives no more pulses at its input 132H and stays blocked in this state. At the same time, the flip flops 136 to 152 all are placed into a state in which their output Q is at "1" and the CPT 166 is reset to to 0 by the "1" signal received by its input 166 RAZ via the inverter 164 and the gate 162.

The output "A>B" of the comparator is at "0". The output 158Q of the FF 158, of which the input 158H receives, inverted, the signal $\phi_2$, changes to "0", if it was not there previously.

The operation of the circuit during the rubbing of a "file" by the user will now be described by taking as example a case where this file comprises groups of three teeth separated by spaces.

When the user commences to rub this file and touches its first tooth, the gate 108 delivers a pulse IMP, as has been described above. While this signal IMP is at "1", the first input of the gate 122 changes to "0". When the signal $\phi_2$ changes to "0" in turn, the input 132 RAZ changes to "1" which resets the counter 132. The output 132Q10 of the latter, and thus the third input of the gate 120, change back to "0".

When the IMP signal changes back to "0", the counter 132 recommences to receive at its input 132H the pulses $\phi_1$ which the gate 120 is able to supply again. As its input 132 RAZ is again at "0" it starts to count these pulses $\phi_1$. The FF 158 receives a "1" signal at its input 158H each time the signal $\phi_2$ changes to "0", but it does not switch since the output A>B of the comparator 134 stays at 0.

When the signal IMP changes back to "1" at the moment when the user touches the second tooth of the file, the gate 126 is disabled by the "0" signal which appears at its first input and the counter 132 stops counting, in a state which corresponds to the number $N_1$ of pulses $\phi_1$ which it has received, this number being less than its counting capacity. This number $N_1$ is a measure of the time $T_1$ which has separated the start of the present pulse IMP from the end of the preceding one. This time will be designated by $T_1$ in the following portion of the description.

As all outputs Q of the flip flops 136 to 152 are, for the moment, at "1", the output "A>B" the comparator 134 has remained at "0" and the FF 158 has not switched. The second input of the gate 154 is thus at "0". The output of this gate changes to "1" when the signal $\phi_1$ itself changes to "1", which causes the current state of the outputs $Q_0$ to $Q_8$ of the counter 132 to be transferred to the outputs 136Q to 152Q of the FF 136 to 152. The register formed by these latter, therefore, now stores, in the form of a binary number $N_1$ of nine bits, the time $T_1$ which separated the two first IMP pulses.

The signal "1" of the output of the gate 154 is also applied to the clock input of the counter 166, the contents of which change from zero to one. The output 158$\overline{Q}$ being always at "1", the output of the gate 156 stays at "0".

When the signal $\phi_2$ changes to "0", before the end of the IMP pulse, the input 132 RAZ changes to "1" and the counter 132 is reset.

At the end of the IMP pulse, the first input of the gate 126 changes back to "1" and the counter 132 can recommence to count the pulses of the signal $\phi_1$.

When the third tooth of the file is reached by the finger of the user or by the object used for rubbing this file, a third IMP pulse is delivered by the gate 108 in the matter described above. The counter 132 thus stops and its state corresponds to the time $T_2$ which separated this third pulse IMP from the second one. This time $T_2$ is represented by the binary number $N_2$ contained in the counter. The least significant bit of this number is represented by the logic state f the output $Q_0$ of the counter 132.

At this instant, the comparator 134 thus receives at its inputs $B_1$ to $B_9$, the number $N_1$ which is stored by the register formed by the FF 136 to 152, and at its inputs $A_1$ to $A_9$, a number $N_2$ which is equal to the number $N_2$ divided by two, the possible remainder of this division being neglected.

After the end of this third IMP pulse this counter 132 recommences to count the pulses of the signal $\phi_1$. This time, however, as the tooth which has just been touched is the last in a group of three and it is separated from the first tooth of the next group by a space which is more than twice as large as the space separating it from the preceding tooth, the number $NM_3$ of pulses counted by the counter 132 up to the start of the fourth IMP pulse is equally more than twice as large as the number $N_2$ which is stored in the register 136–152. In other words, a half of $N_3$ is greater than $N_2$. The result of this is that the output A>B of the comparator 134 changes to "1" before the start of the fourth IMP pulse, signifying by that the detection of a space between two groups of teeth. The change to "0" of $\phi_2$ which follows this changing to "1" thus causes the FF 158 to switch, the output Q of which changes to "1" and the output $\overline{Q}$ of which changes to "0".

At the beginning of the fourth IMP pulse, the counter 132 stops as always. However, its contents are not transferred into the register 136–152 by the following pulse $\phi_1$ since the output of the gate 154 is kept at "0" by the "1" state of the output Q of the FF 158. The counter 166 is thus no longer incremented and its contents remain at two.

In contrast, this pulse $\phi_1$ now causes the output of the gate 156 to change to "1". This signal is used by the control circuit for the watch functions, an example of which will be described below, as an indication that the information present at the output of the counter 166 can now be utilized. This information depends directly on the number of teeth belonging to the group which has just been rubbed. In the present example in which each group has three teeth, this information is represented by the number of two expressed in binary form by the state of the outputs of the counter 166. This number two corresponds to the number of spaces between the teeth of one group. If the file riffle had been formed with groups of four teeth, this information would have been represented by the number three, and so forth.

It can thus be seen that with the circuit described the file which has been rubbed can be determined from the files which are provided on the watch.

An example of the manner in which this information is used will also be described hereinbelow.

As always, the counter 132 is reset before the end of the IMP pulse when $\phi_2$ changes to "0". This time, since the output Q of the FF 158 is at "1", the counter 166 is also reset. The FF 158 itself is reset by the first change to "0" of $\phi_2$ after the end of the IMP pulse.

The operations described above are repeated for the subsequent IMP pulses.

When the last tooth of the file has been reached and the last IMP pulse has been produced, the counter 132 recommences, as always, to count the pulses $\phi_1$. When its contents exceed twice the contents of the register 136–152 the output A>B of the comparator 134 changes back to "1" as described above, the FF 158 switches and the output of the gate 156 changes to "1".

But since this counting is not interrupted by any new IMP pulse, the counter 132 reaches its maximum capacity at the end of a certain time and its output Q10 changes to "1". The register 136–152 is thus reset to a state where all its outputs are at "1", the gate 120 is disabled and the signal $\phi_1$ is interrupted, and the counter 166 is reset. The output A>B of the comparator 134 changes back to "0", the output Q of the FF 158 and the output of the gate 156 also change back to "0" and the circuit is back in its initial state. It stays in this condition until an IMP pulse caused by the rubbing of a tooth of one of the file riffles causes the whole process described above to recommence.

In summary, it can be seen that the circuit shown in FIG. 9 measures the time Tn between two IMP pulses produced by the rubbing of two consecutive teeth and compares this time to the time Tn−1 separating the first of these two pulses from the preceding one. If the comparison shows that Tn is less than or equal to twice Tn−1, the two teeth are considered to be part of the same group of teeth and a counter is incremented. If the comparison shows that Tn is greater than twice Tn−1, the two teeth are considered to be part of two different groups and a signal is emitted to indicate that the information present in the form of a binary number at the output of the counter 166 can be used.

FIG. 9 also comprises, by way of example, a circuit for allowing this information to be used. This circuit is formed by a decoder 168, the data inputs D0 to D2 of which are connected to the outputs Q0 to Q2 of the counter 166. The control input H of this decoder 168 is connected to the output of the gate 156. This decoder, which may for example be similar to the circuit sold by RCA designated CD 4051 B, is arranged in such a manner that for each of the combination of logic states applied to its inputs by the counter 166, one of its outputs changes to "1" when its input H is also at "1".

Thus, for example, if the contents of the counter 166 are two, the output Q2 of the decoder 168 changes to "1" when the output of the gate 156 changes to "1" at the end of a pulse train.

The outputs of the decoder 168 may be connected to circuits for controlling different watch functions, for example, the start and reset of a chronograph, or others, in the same manner as the different push-buttons of a conventional watch are connected to these circuits.

It will be appreciated by those skilled in the art that the above-described electronic circuit is given as an example of one form of the invention. Other circuits permitting, for example, a sequence of one, two or three pulses to be detected after each pause, or any other combination, may be utilized, performing these function by virtue of circuits such as the one described above, or by virtue of microprocessors as are known in the art.

It is thus understood that the form or the arrangement of the ribbed zones may be varied, as desired.

Instead of being formed of one piece with the watch case, the file riffles may be removable and fitted into parts which, when they are not being used, are packed, for example, into the links of the watch band. The file riffles may also be fitted into rings which can be fitted into the periphery of the case. Thus a range of coded file riffles permitting each watch function to be controlled is at the disposal of the user.

Figure 5:
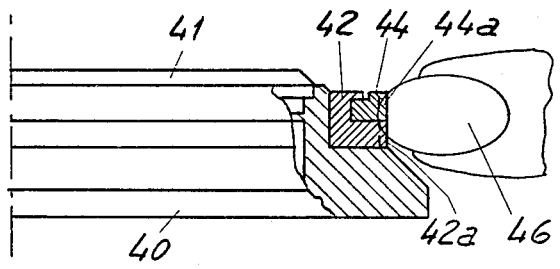
FIG. 5 is a section of a second illustrative embodiment of a watch case.

FIG. 5 represents another illustrative embodiment of the invention in which the case 40 equipped with a glass 41 comprises two coaxial rings 42 and 44 which are superimposed upon one another and equipped with the files 42*a* and 44*a* which can be displaced with respect to one another. The two ribbed zones may be scraped simultaneously by the fingernail 46 of the user.

Figure 6:
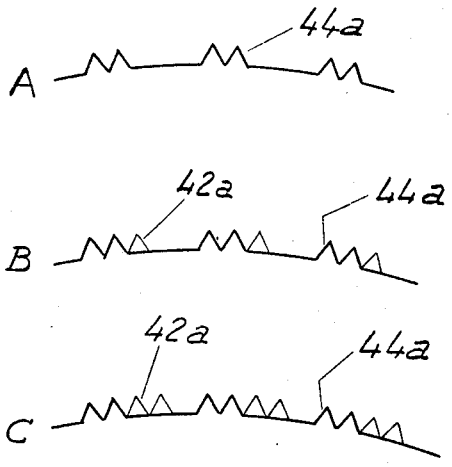
FIG. 6 shows a detail of the case illustrated in FIG. 5.

An example of the profile of the files 42 and 44 of FIG. 5 seen from the top of the watch is given in FIG. 6. The profile of the file 42*a* is drawn in fine lines and that of the file 44*a* in broad lines. The two files have the same profile. At A, the rings are superimposed and as a result the profile shows groups of two teeth separated by spaces corresponding to three teeth. At B, the rings are displaced by the space of one tooth, resulting in groups of three teeth separated by spaces corresponding to two teeth, and at C they are displaced by a space of two teeth, resulting in groups of four teeth separated by spaces corresponding to one tooth.

The files may also be associated with devices looking like conventional push-buttons, and giving to the user the same feeling. This is particularly suitable for controlling a stop watch.

Figure 7:
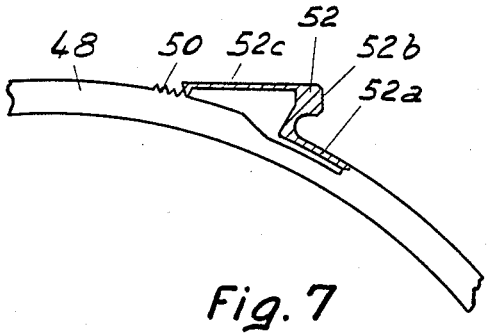
FIG. 7 shows a first illustrative embodiment of a push-button cast with the case of a watch.

FIG. 7 shows a ring 48 equipped with a file 50 and a push-button 52. The latter comprises a flexible leaf 52*a*, a head 52*b* and an arm 52*c* carrying a point which will scrape the profile of the file 50 if the head 52*b* is pushed. Several of these push-button, associated with files of appropriate profile, can perform the desired operations, for example "Start-Stop-Reset."

Figure 8:
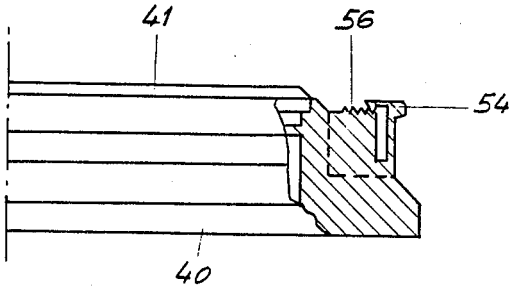
FIG. 8 represents a second illustrative embodiment of a push-button cast with the case of a watch.

Another illustrative embodiment of a push-button is shown in FIG. 8. A push-button 54 with radial movement and a ribbed zone 56 are moulded into the case 40. This push-button operates in the same manner as that shown in FIG. 7.

While several specific illustrative embodiments of the invention have been shown and described, it will be apparent to those skilled in the art that other modifications may be constructed within the contemplation of the invention. It therefore is intended that the scope of the present invention be limited only by the prior art and the appended claims.

What is claimed is:

1. A device for controlling at least one function of an electronic watch provided with a case, comprising:

at least one friction element, mounted on the watch case, having at least one ribbed zone which produces mechanical vibrations in said case when said zone is rubbed with appropriate means by the user of the watch;

an electromechanical transducer which senses said vibrations and supplies an electric signal in response thereto; and electronic means for supplying an output signal in response to said electric signal in order to control said function of the watch.

2. A device according to claim 1 wherein said friction element comprises a plurality of ribbed zones, each ribbed zone when rubbed supplies by virtue of its particular structure, specific mechanical vibrations for controlling a specified function of the watch.

3. A device according to claim 1 wherein said friction element comprises a ring having a plurality of ribbed zones with different structures.

4. A device according to claim 3 wherein said ring is removable so that it can be exchanged for another ring for controlling other watch functions.

5. A device according to claim 2 wherein said friction element is removable and can be exchanged for another element with ribbed zones having different structures for controlling other watch functions.

6. A device according to claim 1 further comprising a push-button provided with means permitting the rubbing of the said ribbed zone.

7. A device according to claim 1 wherein said transducer is of the piezo-electric type.

8. A device according to claim 1, wherein said transducer is of the piezo-resistive type and is integrated with circuits of the said electronic means.

9. A device according to claim 1 wherein said electronic means comprise a pulse shaper for supplying pulses in response to the electric signal supplied by the said transducer, each pulse corresponding to one rib of the said ribbed zone.

10. A device for controlling at least one function of an electronic watch provided with a case comprising:

at least one friction element, mounted on the watch case, having at least one ribbed zone which produces mechanical vibrations when the said zone is rubbed with appropriate means by the user of the watch, said friction element comprising two superimposed rings, each of which being provided with ribbed zones, and means for displacing the said rings with respect to one another for the purpose of controlling a plurality of watch functions;

a transducer which supplies an electric signal in response to the said vibrations; and electronic means which supplies an output signal in response to the said electric signal in order to control said function of the watch.

11. A device for controlling at least one function of an electronic watch provided with a case comprising:

at least one friction element, mounted on the watch case, having at least one ribbed zone which produces mechanical vibrations when the said zone is rubbed with appropriate means by the user of the watch;

a transducer which supplies an electric signal in response to the said vibrations; and electronic means which supplies an output signal in response to the said electric signal in order to control said function of the watch, said electronic means comprising a pulse shaper for supplying pulses in response to the electric signal supplied by the said transducer, each pulse corresponding to one rib of the said ribbed zone; and said friction element comprising a plurality of ribbed zones separated by spaces, the said pulses appearing as pulse trains each of which corresponds to one of the said zones and said electronic means comprising: means for measuring the time separating the said pulses, a register for storing the said time at the end of the said measuring, a comparator for detecting the end of the said pulse trains by comparing the said time measured with the contents of said register, and a counter for counting the number of pulses in one of said pulse trains, the said number of pulses generating the said output signal.

12. A device according to claim 11, wherein said zones are arranged in such a manner that two successive pulse trains are separated by a period of time which is at least equal to twice the period separating two successive pulses of the said pulse trains.

* * * * *